US005277432A

United States Patent [19]

Bateman

[11] Patent Number: 5,277,432

[45] Date of Patent: Jan. 11, 1994

[54] MODULAR TARGET SYSTEM WITH INTERCHANGEABLE PARTS

[76] Inventor: Kyle E. Bateman, P.O. Box 636, Provo, Utah 84603-0636

[21] Appl. No.: 956,332

[22] Filed: Oct. 5, 1992

[51] Int. Cl.[5] ..... F41J 1/10

[52] U.S. Cl. ..... 273/407

[58] Field of Search ..... 273/407

[56] References Cited

U.S. PATENT DOCUMENTS

| | | | |
|---|---|---|---|
| 2,372,111 | 3/1945 | Norberg | 273/407 |
| 3,542,365 | 11/1970 | Gantz | 273/407 |
| 4,433,843 | 2/1984 | Bricco | 273/407 |
| 4,691,925 | 9/1987 | Scholem | 273/407 |
| 4,726,593 | 2/1988 | Wade | 273/407 X |
| 5,145,133 | 9/1992 | France | 273/407 X |
| 5,163,689 | 11/1992 | Bateman | 273/407 X |

*Primary Examiner*—William H. Grieb

[57] ABSTRACT

A modular target system with interchangeable parts which can be used to make a variety of different targets. The basic system consists of a foot, stand, and head. The universal attachment designs for the various components allows for changing the stand height or head plate style, and makes possible the addition of an optional "swinger" or "rocker." The result is a system which is versatile to use and economical to produce and maintain.

3 Claims, 6 Drawing Sheets

MODULAR TARGET SYSTEM WITH INTERCHANGEABLE PARTS

BACKGROUND

Other target systems that are commercially available suffer from one or more disadvantages which this present invention helps remedy. These disadvantages include being larger, heavier, less portable, relatively complex, more difficult to manufacture, less versatile, and more expensive to maintain. This present invention provides a unique modular target system which has a number of interchangeable components which can be bolted together to provide almost any type of traditional target configuration desired.

A universal mounting system allows the assembly of targets which not only provide a variety of different heads, but also portable or permanent footings and optional "rockers" or "swingers." The result of this design is that a wide variety of traditional stationery and moving targets can be assembled from a few basic components, giving significantly greater versatility than any other commercially available design.

SUMMARY

It is an object of the present invention to provide a unique modular target system comprising:

(a) A self-supporting foot consisting of two pieces of bent iron, drilled and attached with a bolt assembly. This design is simple, strong, sturdy in its support, and easy to manufacture. A significant advantage over other bases for targets is that this present invention's "foot" does not require welding. It is also provides for the mounting of both a stand a paper target holder.

(b) An alternate permanent-mounting foot with the same advantages specified in (a) above.

(c) A stand constructed simply of flat and angle iron to which a universal mounting bracket is attached. The stand connects quickly and securely to the foot described in (a) or (b) above. It may be constructed in a variety of heights.

(d) A head constructed from armor plating to which a universal mounting bracket is attached. The head, which may be made in a variety of shapes and sizes, connects quickly and securely to the stand described in (c) above or to the optional "rocker" described in (e) below or to the optional "swinger" described in (f) below.

(e) An optional "rocker" which can be attached between the stand and the head. The result provides a moving target which rocks back and forward, in and out of the sight of the shooter.

(f) An optional "swinger" which can be attached between the stand and the head. The result provides a moving target which swings sideways, left and right, to the view of the shooter. The swinger also allows for the attachment of an additional lower head, providing a counterbalanced target which rotates in a full circle.

(g) the means for providing, through the universal mounting design of the components described above, a wide variety of stationery and moving targets which can be assembled from a few basic components, giving significantly greater versatility than any other commercially available design.

DESCRIPTION OF THE PREFERRED EMBODIMENT

Referring to the accompanying drawings, there are illustrated preferred embodiments of the components of the Modular Target System with Interchangeable Parts according to the present invention.

Figure 1:
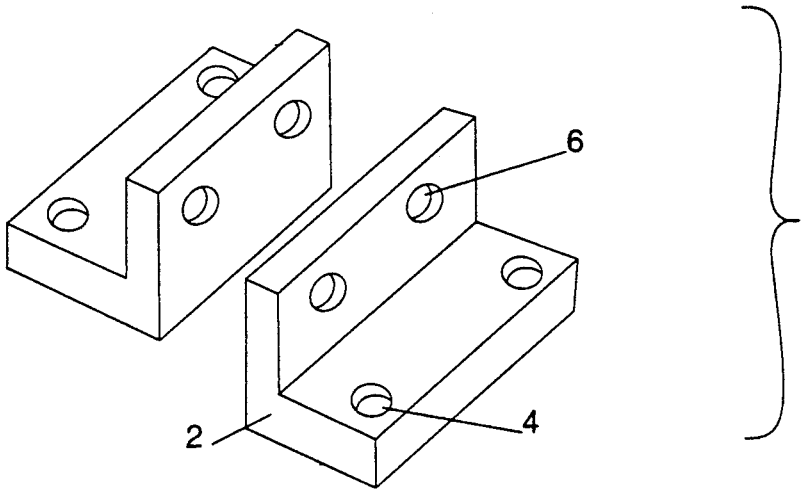
FIG. 1 shows a basic embodiment of the permanent-mounting foot for the Modular Target System with Interchangeable Parts in accordance with the present invention.
Figure 3:
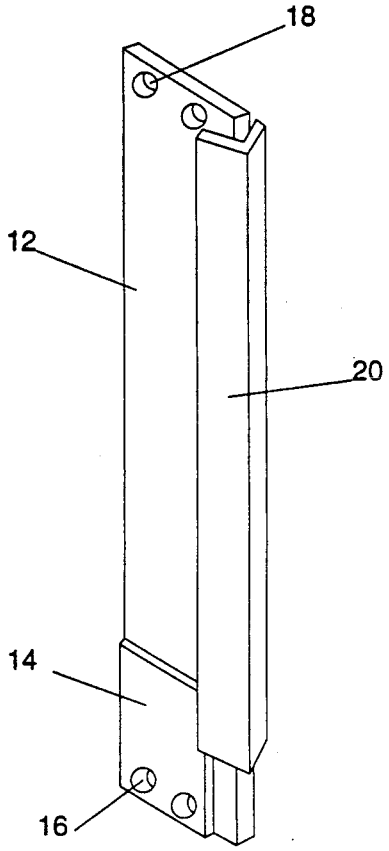
FIG. 3 shows a basic embodiment of the "stand" for the Modular Target System with Interchangeable Parts in accordance with the present invention.
Figure 4:
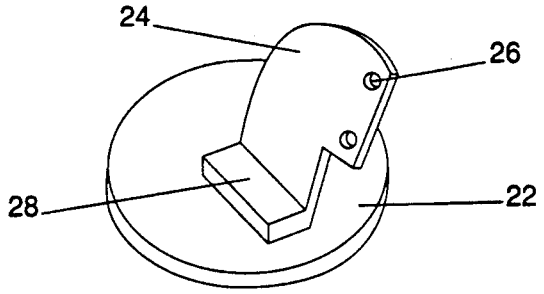
FIG. 4 shows a basic embodiment of the "head" for the Modular Target System with Interchangeable Parts in accordance with the present invention.

The permanent-mounting foot (FIG. 1) is preferably comprised of two pieces of angle iron (2) through which holes (4) have been drilled for attachment to a solid base and through which holes (6) have been drilled for connection by means of a bolt assembly to either a stand (FIG. 3) or a head (FIG. 4).

The self-supporting foot (FIG. 2) is preferably comprised of two pieces of bent flat iron (8) through which holes (10) have been drilled for connection by means of a bolt assembly to either a stand (FIG. 3) or a head (FIG. 4).

Figure 2:
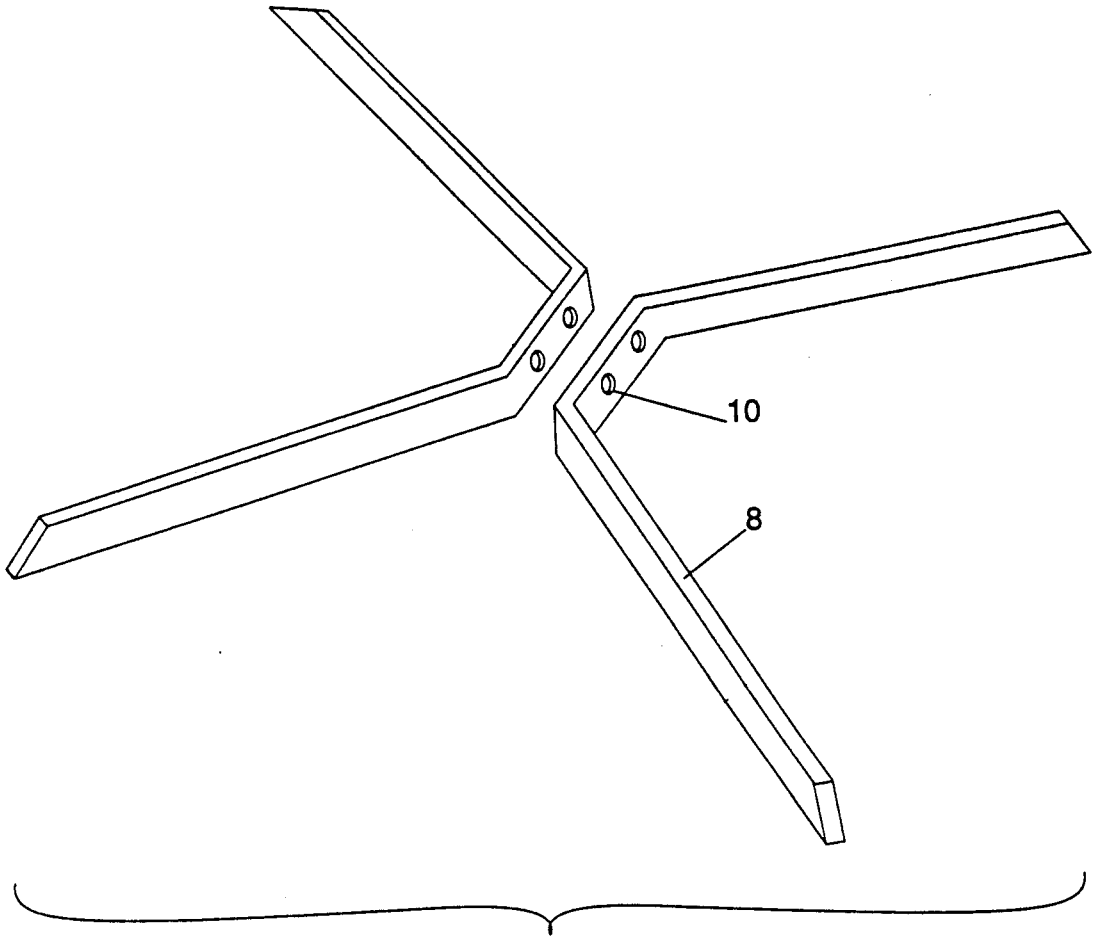
FIG. 2 shows a basic embodiment of the self-supporting foot for the Modular Target System with Interchangeable Parts in accordance with the present invention.

The stand (FIG. 3) is preferably comprised of a piece of flat iron (12) to the bottom of which two pieces of additional flat iron (14) have been welded for stability. Holes (16) are drilled though these pieces of flat iron (12 & 14) to allow for attachment by means of a bolt assembly to either a permanent-mounting foot (FIG.1) or a self-supporting foot (FIG. 2).

Figure 6:
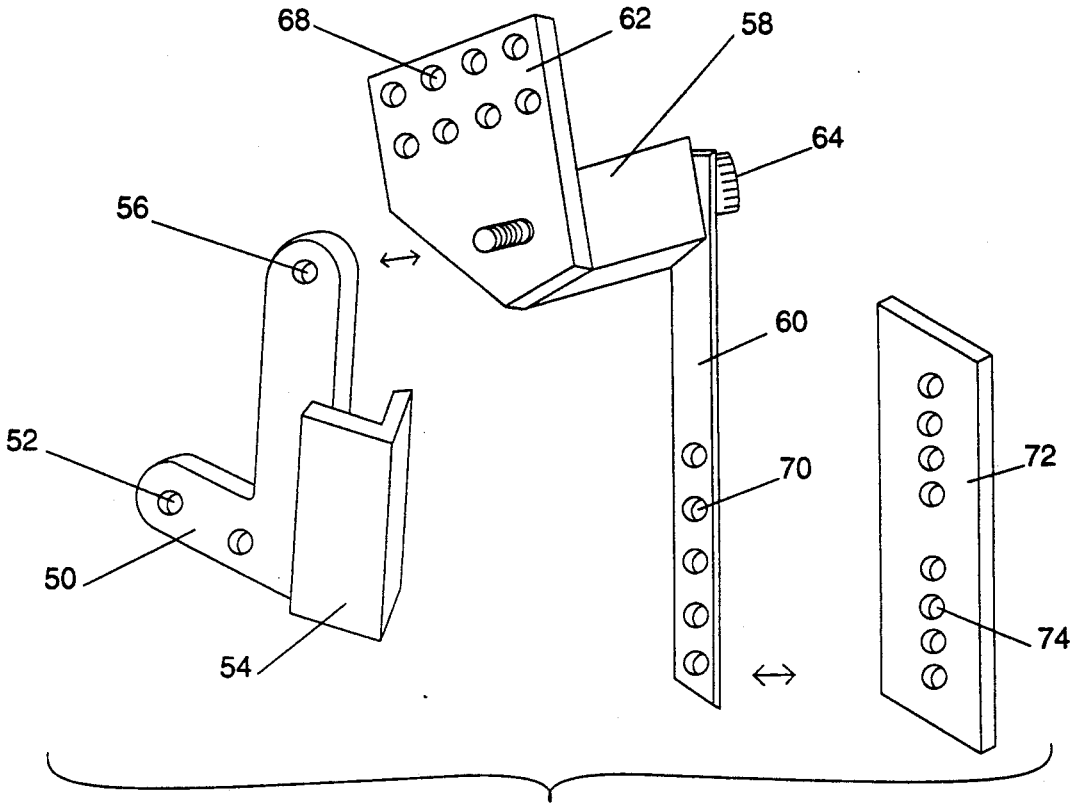
FIG. 6 shows a basic embodiment of the optional "rocker" in accordance with the present invention.
Figure 7:
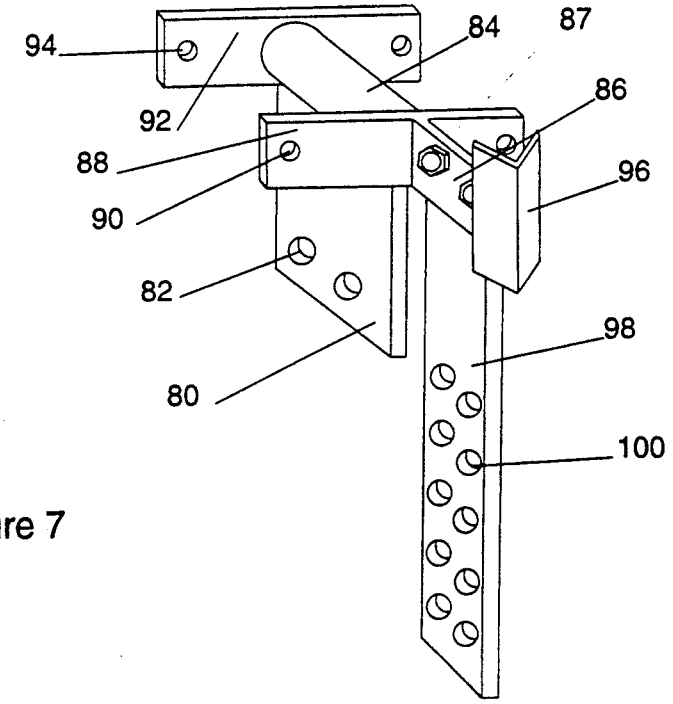
FIG. 7 shows a basic embodiment of the optional "swinger" in accordance with the present invention.

Holes (18) are also drilled through the top of the flat iron (12) to allow for the attachment by means of a bolt assembly to a head (FIG. 4), a paper target (FIG.5), a "rocker" (FIG. 6), or a "swinger" (FIG.7).

A piece of angle iron (20) is also welded to the flat iron (12) to provide a deflection shield for bullets shot at the target.

The head (FIG. 4) is preferably comprised of a head plate (22) (which may be a variety of shapes) preferably constructed from armor plate to which a head plate bracket (24) is welded. Holes (26) are drilled through the the head plate bracket (24) for attachment by a bolt assembly to a stand (through holes 18 in FIG. 3), to a "rocker," (through holes 68 in FIG. 6), or to a "swinger" for use as either a target (in which case attachment would be through holes 87 in FIG. 7) or as a counterweight (in which case attachment would be through holes 100 in FIG. 7). The bent portion (28) of the head pate bracket (24) provides good stability when welded to the the head plate (22).

The paper target holder (FIG. 5) is preferably comprised of a piece of flat iron (30) to which a mounting bracket (32) is welded. Holes (34) are drilled through the mounting bracket (32) for attachment by a bolt assembly to a permanent-mounting foot (holes 6 in FIG. 1), a self-supporting foot (holes 10 in FIG. 2), a stand (through holes 18 in FIG. 3), a "rocker," (through holes 68 in FIG. 6), or to a "swinger," through holes 87 in FIG. 7).

Two attached lath clamps (36), preferably fabricated from bent metal, can be tightened by use of a wing bolt (38) and nut (40) to clamp two pieces of lath (42) to which a paper target (44) can be stapled.

The "rocker" (FIG. 6) is preferably fabricated from metal components. The neck mounting bracket (50) has holes (52) drilled through it for attachment by means of a bolt assembly to a stand (through holes 18 in FIG. 3). A piece of angle iron (54) is welded to the neck mounting bracket (50) as a shield to deflect bullets. A hole (56) is drilled through the neck mounting bracket (50) for attachment to the target mounting surface (62).

The target mounting surface (62) is welded to a piece of angle iron (58) which is welded to the rocker arm (60). The target mounting surface (62) attaches to the neck mounting bracket (50 by means of a rocker pin (64) and nut (not shown) which attachment allows the target mounting surface to rotate freely against the the neck mounting bracket (50) which is attached firmly to a stand (FIG. 3).

Holes (68) are drilled through the target mounting surface (62) through which a target head (FIG. 4) or a paper target holder (FIG. 5) can be attached by means of a bolt assembly. A number of holes (68) are provided in order to allow different heads to be attached at different angles and for weight adjustment.

Holes (70) are drilled in the rocker arm (60) to provide for attachment of the counterweight (72) by means of a bolt assembly through the holes (74) in said counterweight.

The "swinger" (FIG. 7) is preferably fabricated from metal components. The neck mounting bracket (80) has holes (82) drilled through it for attachment by means of a bolt assembly to a stand (through holes 18 in FIG. 3). A metal tube (84) is welded to the neck mounting bracket (80). These two components (80 & 84) are stationery. The other components are all connected and move in a swinging motion from side to side.

The stationery components attach to the moving components by means of a lubricated rod (not shown) that connects the front lever arm (88) with the rear lever arm (92) through the metal tube (84). Welded to the front lever arm (88) is the target mounting surface (86), through which holes (87) are drilled for attachment of a target head (FIG. 4) or a paper target holder (FIG. 5) by means of a bolt assembly. Also attached at the same point is the neck (98).

Figure 10:
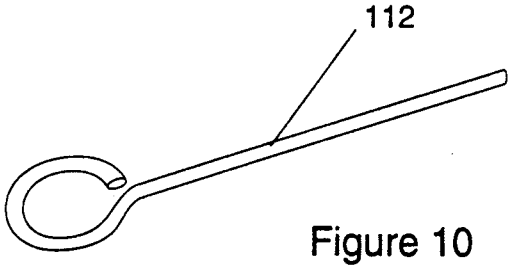
FIG. 10 shows a basic embodiment of a pull pin which may be used with the present invention.
Figure 11:
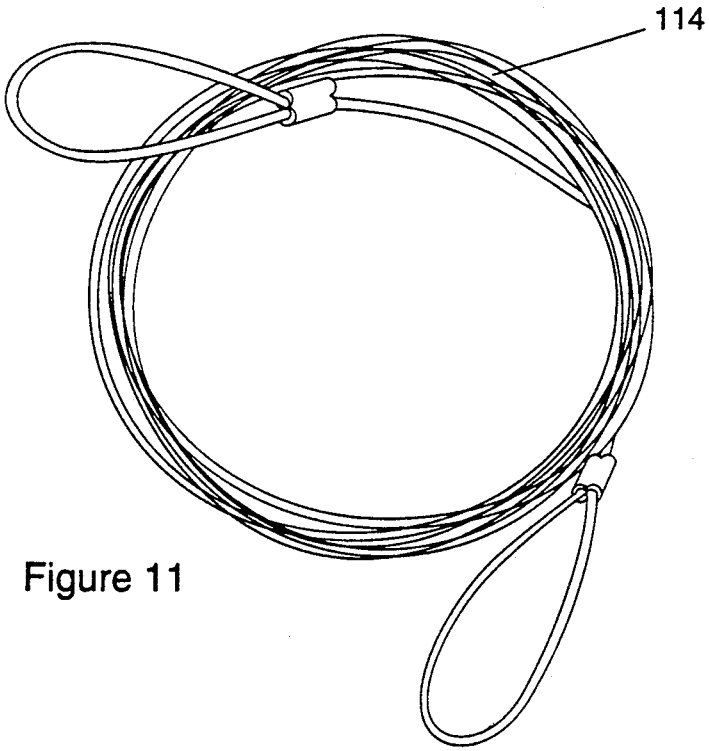
FIG. 11 shows a basic embodiment of a pull cable which may be used with the present invention.

A piece of angle iron (96) is welded to the target mounting surface (86) to deflect bullets. Holes (100) are drilled in the neck (98) to allow for the attachment of a target head (FIG. 4) for use as a counterweight. Holes (90) in the front lever arm (88) are used for setting up the rocking motion by means of the pull pin (FIG. 10). Holes in the rear lever arm (92) are used for setting up the rocking motion by means of the pull cable (FIG. 11)

Figure 8:
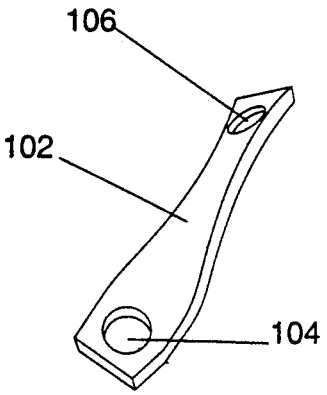
FIG. 8 shows a basic embodiment of a cable bracket which may be attached to the present invention.

The cable bracket (FIG. 8) is preferably fabricated from a short piece of twisted metal bar (102) through which holes (104 & 106) have been drilled. The bracket is attached by one hole (104) to a foot (FIGS. 1 or 2) by means of a bolt assembly though mounting holes (6 in FIG. 1, and 10 in FIG. 2). The other cable bracket hole (106) is used as a guide through which a cable (FIG. 11) is run.

The stop bracket (FIG. 9) is preferably fabricated from a short piece of bent metal bar (108) through which holes (110) have been drilled. The bracket is attached by one of the holes (110) to the stand (through 18 in FIG. 3). The stop bracket is used to help set up a "knock down"target system using the "rocker" mechanism (FIG. 6).

The pull pin (FIG. 10) is preferably fabricated from a piece of metal rod (112) bent as illustrated to provide a loop for connecting a cable.

The pull cable (FIG. 11) is a commercially available light-weight steel cable (114) with looped ends.

The operation of the preferred embodiments of this present invention is basically as follows:

The operator decides what kind of target setup is desired and the related components are assembled using bolts and nuts. Each setup will consist of one "foot" and one "head" plus other components as required.

Figure 12:
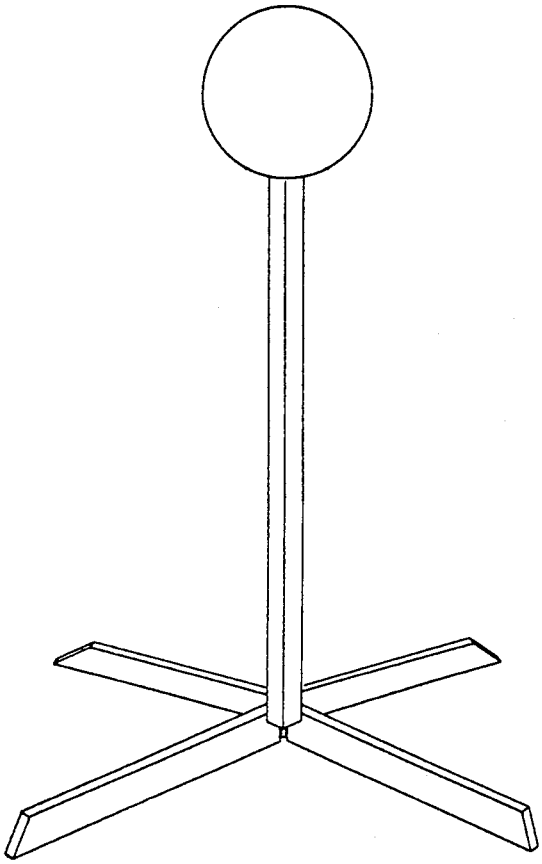
FIG. 12 shows a front angle of an embodiment of one variation of the present invention using a self-supporting foot, a stand, and a round head, creating a stationery target.

A typical static plate configuration can be assembled by attaching a stand (FIG. 3) to a a self-supporting foot (FIG. 2) and a head (FIG. 4). The result of this setup is illustrated as FIG. 12.

Figure 13:
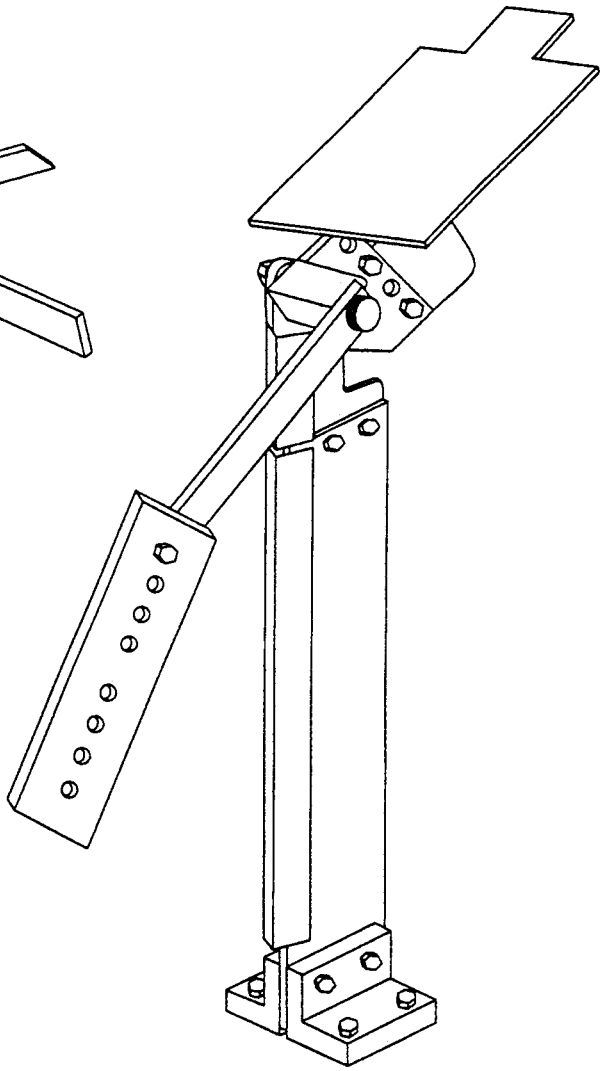
FIG. 13 shows a side angle of an embodiment of one variation of the present invention using a permanent-mounting foot, a stand, an optional "rocker" and a modified rectangular head, creating a target which rocks backward and forward.

A typical rocker configuration can be assembled by attaching stand (FIG. 3) to a permanent-mounting foot (FIG. 1), a "rocker" (FIG. 6) and a head (FIG. 4). The result of this setup is illustrated as FIG. 13. The "rocker" can be used to achieve several effects including a pop-up target, a knock-down target, and a rocking hit-sensitive target. Each effect requires a slightly different setup, which will be explained in greater detail later.

The target mounting surface (62 in FIG. 6) has a number of holes (68) in it to allow the head (FIG. 4) or paper target holder (FIG. 5) to be mounted in different positions, each with a slightly different balance.

If a rocking target is desired, the head (FIG. 4) is attached to the lower rear mounting holes (68), and the counterweight (72) is attached to one of the lower holes (70) in the rocker arm (60). This weight causes the head (FIG. 4) to rise up to the vertical position. By moving the counterweight (72) up and down or the rocker arm (60), the amount of force which pulls the head (FIG. 4) back to the vertical position can be adjusted. By moving the counterweight (72) forward and backward, the angle of the head (FIG. 4) when it comes to rest can be adjusted as well. Once the right adjustment is found, the bolts used to mount the counterweight (72) can be tightened. When the head (FIG. 4) is struck by a bullet, it will rock backwards slowly, and then return to a vertical position.

Figure 9:
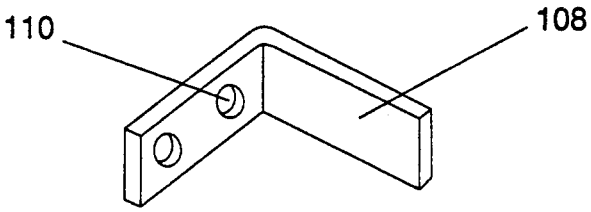
FIG. 9 shows a basic embodiment of a stop bracket which may be attached to the present invention.

By shifting the weight forward and slightly upward, the target head (FIG. 4) will rock forward or backward, but will not stay in a vertical position. If the stop bracket (FIG. 9) is installed as previously explained, the head (FIG. 4) will begin to rock forward, but the rocker arm (60) will stop the motion by hitting the stop bracket (FIG. 9). This means that the head (FIG. 4) can be knocked down and will stay down until reset. The system can be reset by pulling the pull cable (FIG. 11) which has been run through the cable guide (FIG. 8) (mounted as explained previously) and attached to one of the holes in the counterweight (72).

Figure 5:
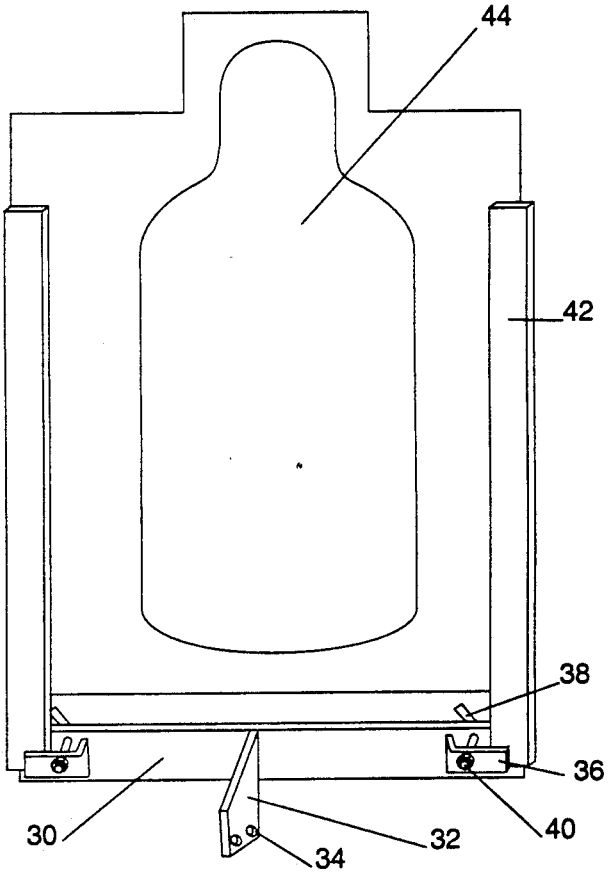
FIG. 5 shows a basic embodiment of an optional paper target holder in accordance with the present invention.
Figure 14:
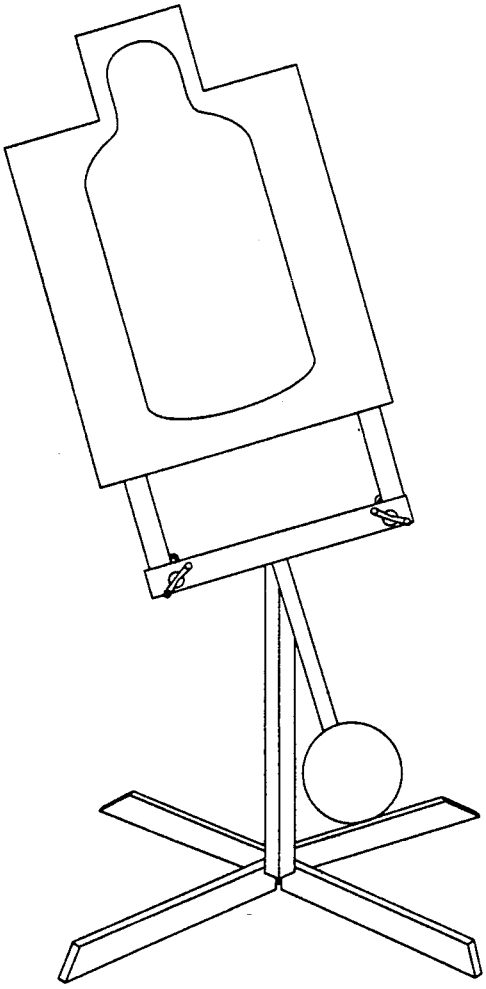
FIG. 14 shows a front angle of an embodiment of one variation of the present invention using a self-supporting foot, a stand, and an optional "rocker," to which an paper target holder has been mounted and a rectangular head has been attached for balance, creating a target which swings from side to side.

A typical swinger configuration can be assembled by attaching a stand (FIG. 3) to a self-supporting foot (FIG. 2), a "swinger" (FIG. 7) with a head (FIG. 4) for a counterweight, and a paper target holder (FIG. 5). The result of this setup is illustrated as FIG. 14.

The head (FIG. 4) can used to provide the significant weight needed at the lower end of the neck (98) to keep the target swinging back and forth as desired. The various holes (100) in the neck (98) allow for adjusting proper balance depending on the weight used.

One way to create motion is by use of the pull pin (FIG. 10). The target is rotated to one side 90 degrees so it is parallel with the ground. The pull pin (FIG. 10) is inserted through the hole (90) in the front lever arm (88) and the hole (94) in the rear lever arm (92) to hold the target in place. The pull cable (FIG. 11) can be attached to the loop in the pull pin (FIG. 10) and pulled out vigorously to start the side to side motion of the target.

Another way to move the target is by use of the cable bracket (FIG. 8) which is installed as previously explained. The pull cable (FIG. 11) is run through the upper hole (106) of the cable bracket (FIG. 8) and attached through a hole (94) in the rear lever arm (92). By pulling the pull cable gently, the swinging momentum of the target can be started and increased as desired, even causing the target to rotate in a full circle.

Figure 15:
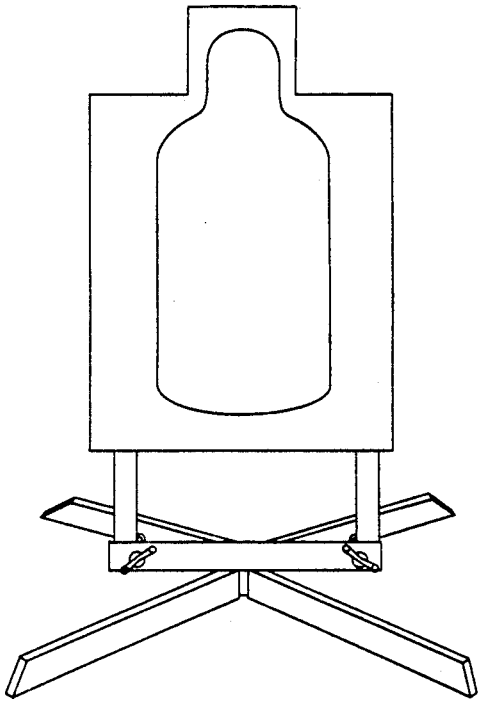
FIG. 15 shows a front angle of an embodiment of one variation of the present invention using a self-supporting foot to which a paper target holder has been directly mounted without the use of a stand, creating a stationery target.

Another static configuration can be assembled by attaching a paper target holder (FIG.5) directly to a self-supporting foot (FIG. 2). The result of this setup is illustrated as FIG. 15.

The illustrations provided are only a few of the target setup combinations possible. It is understood that the present invention is not limited to the preferred embodiments presented or the variations thereof described but is susceptible to a number of modifications as are apparent to one skilled in the art. I do not, therefore, wish to limit the present invention to the details shown and described herein, but do intend to cover all modifications which are obvious to one skilled in the art.

The embodiments of the invention in which an exclusive property or privilege is claimed are defined as follows:

1. A modular target system comprising:

(a) a self-supporting foot comprising two pieces of bent iron, drilled and attached with a bolt assembly, providing for the mounting of both a stand and a paper target holder;

(b) a permanent-mounting foot comprised of two pieces of angle iron, drilled for attachment with a bolt assembly for the allowing connection to a solid surface, also providing for the mounting of both a stand and a paper target holder:

(c) a stand constructed of flat and/or angle iron and drilled to allow attachment by means of a bolt assembly to the foot described in (a) and (b) above, and also drilled to allow attachment by bolt assembly to a head as in (d) below, a paper target holder as in (e) below, a rocker as in (f) below, and a swinger as in (g) below;

(d) a head constructed from armor plating to which a universal mounting bracket is attached, which head connects to the stand described in (c) above, to the "rocker" described in (f) below to the swinger described in (g) below:

(e) a paper target holder constructed of flat iron to which a mounting bracket is welded, said bracket is drilled for attachment by a bolt assembly to a self-supporting foot as in (a) above, a permanent foot as in (b) above, and a stand as in (c) above, and also to a "rocker" described in (f) below, and to a "swinger" described in (g) below, and which flat iron is also drilled to allow the attachment of two lath clamps fabricated from bent metal and used to grasp, through use of nut and bolt, two pieces of lath to which a paper target can be stapled;

(f) a rocker, which is attachable between the stand and the head, providing a moving target which rocks back and forward, in and out of the line of sight of a shooter;

(g) a swinger which is attachable between the stand and the head, providing a moving target which swings sideways, left and right, to line of sight of a shooter, said swinger also allows for attachment of an additional head, providing a counterbalanced target which rotates in a full circle;

(h) whereby, through the universal mounting design of the components described above, a wide variety of stationary and moving targets can be assembled from a few basic components.

2. A system according to claim 1 wherein through the use of a bracket and a cable, a resettable knock-down or pop-up target may be assembled.

3. A system according to claim 2 wherein maintenance is minimized because components are designed to avoid damage from bullets through the use of deflection shields and minimal exposed area and because all components are modular and can be readily disassembled and replace.

* * * * *